US007793386B2

(12) United States Patent
Gianandrea

(10) Patent No.: US 7,793,386 B2
(45) Date of Patent: Sep. 14, 2010

(54) NON-RETRACTABLE FURNITURE GLIDE

(76) Inventor: Michael Gianandrea, 1028 Clegg Ct., Petaluma, CA (US) 94954

( * ) Notice: Subject to any disclaimer, the term of this patent is extended or adjusted under 35 U.S.C. 154(b) by 377 days.

(21) Appl. No.: 11/874,052

(22) Filed: Oct. 17, 2007

(65) Prior Publication Data

US 2008/0086845 A1 Apr. 17, 2008

Related U.S. Application Data

(60) Provisional application No. 60/829,849, filed on Oct. 17, 2006, provisional application No. 60/869,873, filed on Dec. 13, 2006.

(51) Int. Cl.
*A47B 91/06* (2006.01)

(52) U.S. Cl. ..... 16/42 R

(58) Field of Classification Search ..... 16/42 R, 16/42 T, 37–39, 43; 248/188, 188.9, 188.5, 248/6, 346.11, 188.4
See application file for complete search history.

(56) References Cited

U.S. PATENT DOCUMENTS

| | | | | | |
|---|---|---|---|---|---|
| 2,564,635 | A * | 8/1951 | Becker | 16/42 T |
| 2,640,219 | A * | 6/1953 | Becker | 16/42 R |
| 2,641,016 | A * | 6/1953 | Kramcsak, Jr. | 16/39 |
| 3,166,782 | A * | 1/1965 | Miller | 16/42 R |
| 3,755,853 | A * | 9/1973 | Barile | 16/42 R |
| 4,005,841 | A * | 2/1977 | Rensland et al. | 248/188.7 |
| 4,327,461 | A | 5/1982 | Wisniewski | |
| 4,798,359 | A | 1/1989 | Ball | |
| 5,170,972 | A * | 12/1992 | Casals Guell | 248/188.9 |
| 5,287,595 | A | 2/1994 | Stevens, Jr. | |
| 5,573,212 | A * | 11/1996 | Palazzolo | 248/188.9 |
| 5,988,574 | A | 11/1999 | Podgorski | |
| 6,088,877 | A * | 7/2000 | Swy et al. | 16/42 T |
| 6,324,725 | B1 | 12/2001 | Green | |
| 6,623,082 | B1 * | 9/2003 | Huang | 248/188.9 |
| 6,883,763 | B2 * | 4/2005 | Bosman et al. | 248/188.9 |
| 6,915,993 | B2 | 7/2005 | O'Leary | |
| 2007/0089266 | A1 * | 4/2007 | Beshore | 16/42 R |

* cited by examiner

*Primary Examiner*—Chuck Y. Mah
(74) *Attorney, Agent, or Firm*—Craig M. Stainbrook; Stainbrook & Stainbrook, LLP

(57) ABSTRACT

A furniture glide for installation in the leg of an article of furniture. The glide, which strongly resists removal after installation, includes a head portion having a center, a ground engaging side, and a furniture facing side, a stem disposed from the center of the furniture facing side of the head, and a plurality of truncated conical flutes, each having an angled side and a flat side and including at least one recess so as to create and define a plurality of anchor points that grip the interior side of an installation socket and effectively prohibit rotation and removal of the glide. In a preferred embodiment, one or more of the flute may be shaped eccentrically relative to the other flutes so as to accentuate its anchor points. A fin may be added to one or more of the flutes to provide auxiliary structure for resisting rotation.

4 Claims, 2 Drawing Sheets

NON-RETRACTABLE FURNITURE GLIDE

CROSS REFERENCES TO RELATED APPLICATIONS

The present application claims the benefit of the filing date of U.S. Provisional Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to furniture glides, and more particularly to a non-retractable furniture glide.

2. Discussion of Related Art Including Information Disclosed Under 37 CFR §§1.97, 1.98

Furniture glides are well known. Numerous designs have been proposed to meet a variety of needs and for use in a variety of environments. Exemplary domestic patents showing related art include the following:

U.S. Pat. No. 4,327,461 to Wisniewski, discloses a three furniture glides in a combination apparatus which enables the manufacturer to supply two or three different types of glides with one basic glide unit having common parts. The first glide member is made of hard plastic and has a rounded, bottom shoulder surrounding a downwardly opening cavity therein. A second glide member comprises a soft, plastic member seated within said cavity and projecting a short distance below said rounded shoulder, at least when the glide is unweighted. A third glide member comprises a metal cap which seats over the second glide member and against first glide member to provide a metal bottom surface type of glide.

U.S. Pat. No. 4,798,359, to Ball, teaches a self-adjusting furniture glide having an upper body piece rotatably mounted to a lower foot piece with an arcuate ramp surface on which a complimentary ramp surface of the body piece rests. A coil spring is mounted between the foot and body pieces to bias the foot pieces downwardly and to apply a torque which opposes mutual rotation of the pieces.

U.S. Pat. No. 5,287,595 to Stevens, Jr., shows a combination glide and pintle integrally molded in one piece from a thermoplastic.

U.S. Pat. No. 5,988,574, to Podgorski, et al., discloses a furniture glide assembly including a threaded rod, a convex glide foot, and an retractable glide foot, wherein the furniture associated with the glide assembly is essentially immobile when the glide foot is engaged, wherein the furniture can be easily moved when the glide foot is retracted.

U.S. Pat. No. 6,324,725, to Green, teaches a replaceable furniture glide formed as a cap to be snapped over the existing glide and having a stippled bottom surface. The stipples allow debris on a floor to pass under the glide without becoming embedded in the contact surface between the glide and the floor, thereby preventing the glide from scratching or marring the floor surface.

U.S. Pat. No. 6,915,993, to O'Leary, shows a furniture glide having a cylindrical elastomeric body with a first end and a second end, an integrally formed bulbous support positioned at the first end of the body, and at least two integrally formed discrete engagement members positioned at the second end of the body with a centrally positioned gap between the engagement members. Upon insertion of a pressure member into the gap when the second end of the body is positioned within the tubular furniture leg, the engagement members are forced outwardly and into engagement with the tubular furniture leg.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described herein.

BRIEF SUMMARY OF THE INVENTION

The present invention is non-retractable furniture glide.

It is an object of the present invention to provide a new and improved furniture glide especially suited for use in institutional settings, such as prisons and mental health institutions, that eliminates the possibility of removing the glide for use as a weapon.

It is another object of the present invention to provide a new and improved furniture glide that cannot be removed from a furniture leg or other surface engaging furniture structure.

A further object or feature of the present invention is to provide a new and improved furniture glide that comprises a single piece of inexpensive but durable material.

An even further object of the present invention is to provide a novel furniture glide having high lubricity while also having high durability.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out in the specification, but the invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the specification be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 3:
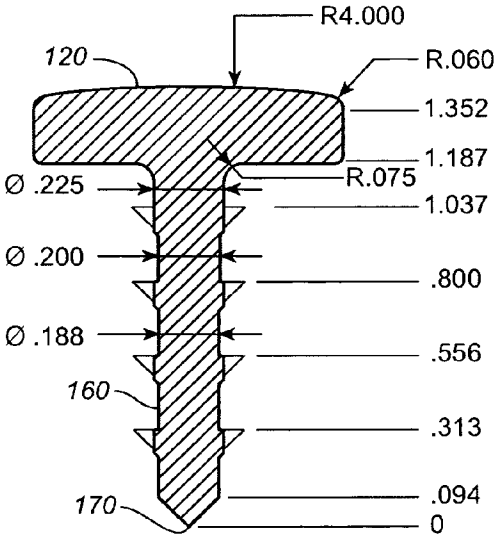
FIG. 3 is a cross-sectional side view in elevation of the furniture glide of FIGS. 1 and 2 taken along section line 3-3 of FIG. 4.
Figure 4:
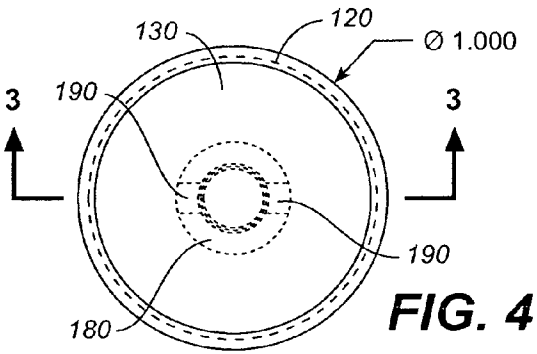
FIG. 4 is a top plan view of the first preferred embodiment of the inventive furniture glide.
Figure 1:
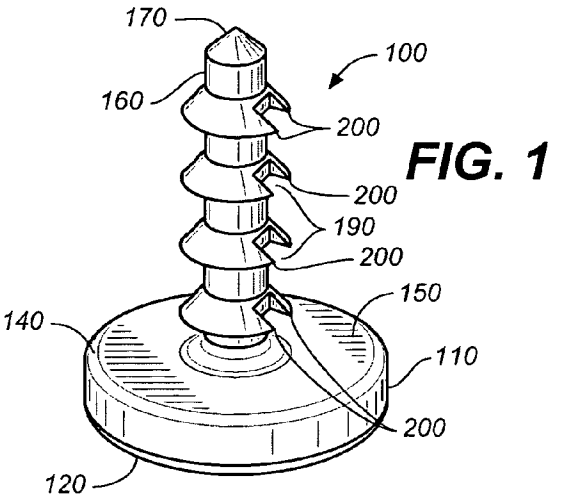
FIG. 1 is a lower perspective view of a first preferred embodiment of the furniture glide of the present invention.
Figure 2:
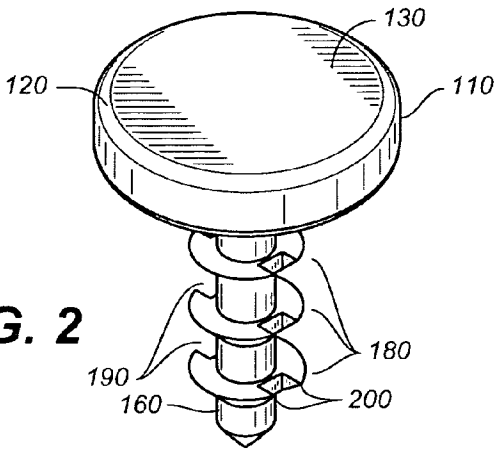
FIG. 2 is an upper perspective view thereof.

Referring first to FIGS. 1 through 4, wherein like reference numerals refer to like components in the various views, there is illustrated therein a new and improved non-retractable furniture glide, generally denominated 100 herein. The views collectively show that the inventive apparatus comprises a head portion 110, preferably a disk having a bevel 120 at the circumference on the ground engaging side 130, and a bevel 140 on the furniture facing side 150.

In a preferred embodiment, the head is approximately one inch in diameter and approximately ¼ inch thick.

A stem 160 having a pointed end 170 is disposed from the center of the furniture facing side and includes a plurality of discrete, truncated conical flutes 180, each disposed concentrically around the stem and preferably including at least one recess 190 to facilitate installation and to create a plurality of anchor points 200. In the first preferred embodiment, each flute includes two recesses disposed 180 degrees apart and around the stem on each flute, thus creating four anchor points per flute. The stem in the first preferred embodiment is approximately 1⅛ inches long, and the flutes include an angled side and a flat side, so as to facilitate driving the stem into a suitably sized hole in the leg of an article of furniture, but also to complement the anchor points in resisting removal of the glide from the leg once installed.

Figure 7:
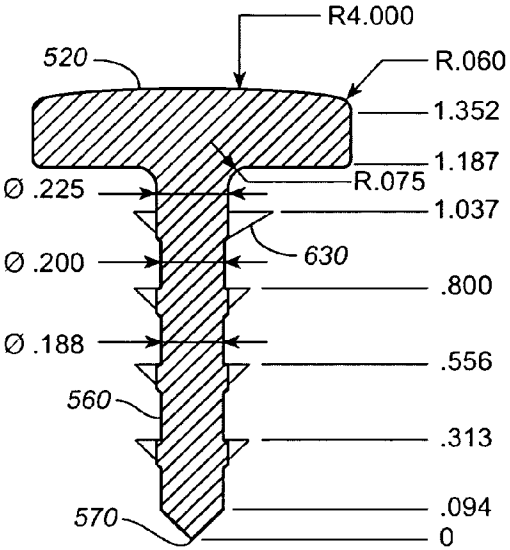
FIG. 7 is a cross-sectional side view in elevation of the furniture glide of FIGS. 5 and 6 taken along section line 7-7 of FIG. 8.
Figure 8:
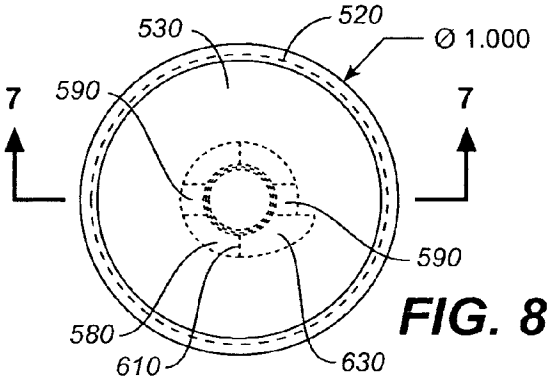
FIG. 8 is a top plan view of the second preferred embodiment of the inventive furniture glide.
Figure 5:
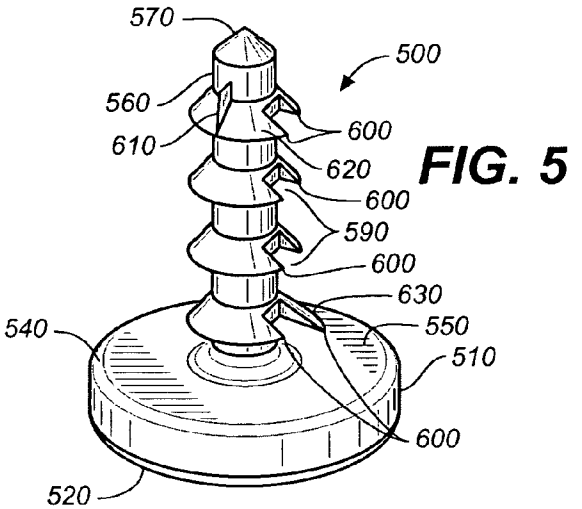
FIG. 5 is a lower perspective view of a second preferred embodiment of the furniture glide of the present invention.
Figure 6:
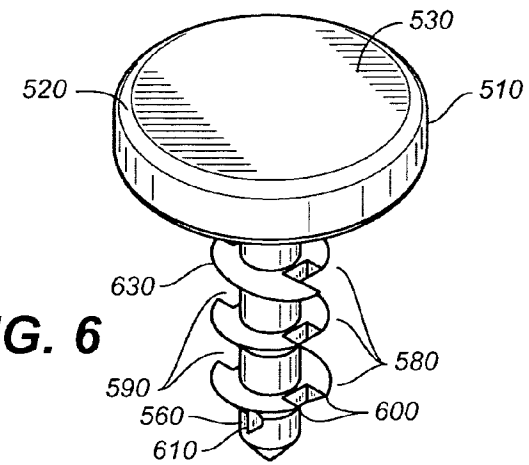
FIG. 6 is an upper perspective view thereof.

Referring next to FIGS. 5 through 8, wherein like reference numerals refer to like components in the various views, there is illustrated therein a second preferred embodiment of the non-retractable furniture glide of the present invention, generally denominated 500 herein. In this embodiment, furniture glide apparatus comprises a head portion 510, again preferably a disk having a bevel 520 at the circumference on the ground engaging side 530, and a bevel 540 on the furniture facing side 550.

A stem 560 having a pointed end 570 is disposed from the center of the furniture facing side and includes a plurality of truncated conical flutes 580, each preferably including a recess 590 to facilitate installation and to create a plurality of anchor points 600. In the preferred embodiment, the stem is approximately 1⅛ inches long.

Additionally, in the second preferred embodiment, at least one, and preferably two, fins 610 are disposed normal to the longitudinal axis of stem 560 on the angled side 620 of the flute most distal to the head portion 510. This further aids in preventing rotation in and egress from an installation hole. Additional security can be provided by providing an eccentric portion 630 on the flute most proximal to the head portion. With these two features, the glide is extremely difficult to turn in its installation hole without employing special tools.

Installation of each embodiment is simple and quick and entails drilling a 19⁄64 inch hole for a tight fit, or a 5⁄16 inch hole for a slightly looser fit. The glide is then simply inserted and pressed into the hole. As it is pressed in the hole, the flutes compress and nominally bend, but when fully inserted, the flutes and their respective anchor points engage the interior side of the hole and entirely prevent excursion, removal, or retraction.

Accordingly, when installed, the inventive furniture glide is effectively permanent. Thus, it prevents use of the glide as a weapon, though use in potentially violent environments is not its only advantage. The glide is preferably manufactured of nylon 6, which has high lubricity and is suitable for use on any floor surface, including carpet, hardwood, tile, linoleum, or synthetic wood.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. For instance, those with skill will appreciate that rather than providing two channels in the flute configuration, a single channel, three or more channels, or only partial flute channels can be provided. This will vary the number of anchor points to facilitate a secure installation, but such variations are contemplated in the present disclosure. Additionally, a plurality of fins can be included along the side of the post or shaft of the glide. While it is believed that one or two fins disposed on the distal flute is sufficient, a plurality may be provided to further secure the glide and to resist turning after installation.

Therefore, the above description and illustrations should not be construed as limiting the scope of the invention, which is defined by the appended claims.

What is claimed as invention is:

1. A non-retractable furniture glide, comprising:

a head portion having a center, a ground engaging side, and a furniture facing side;

a stem disposed from the center of said furniture facing side of said head portion and having a generally pointed tip;

a plurality of truncated conical flutes, each of said flutes being disposed concentrically around the stem and having an angled side and a flat side and including at least one recess so as to create and define a plurality of anchor points; and at least one fin disposed on an angled side of at least one of the flutes.

2. The apparatus of claim 1, wherein said at least one fin is substantially normal to the longitudinal axis of said stem on said angled side of a flute most distal in relation to said head portion.

3. The apparatus of claim 1, wherein at least one of said flutes includes an eccentric portion on at least one of said flutes.

4. The apparatus of claim 3, wherein said eccentric portion is on a flute most proximal in relation to said head portion.

* * * * *